US005465433A

United States Patent [19]

Nolan

[11] Patent Number: 5,465,433

[45] Date of Patent: Nov. 14, 1995

[54] SEAT LIFT

[76] Inventor: J. David Nolan, 132 Don Allen Rd., Louisville, Ky. 40207

[21] Appl. No.: 254,400

[22] Filed: Jun. 6, 1994

[51] Int. Cl.[6] ..... E04H 4/14; A47K 3/12

[52] U.S. Cl. ..... 4/496; 4/563.1

[58] Field of Search ..... 4/560.1–566.1; 414/921

[56] References Cited

U.S. PATENT DOCUMENTS

| | | | |
|---|---|---|---|
| 2,087,286 | 7/1937 | Hicks . | |
| 3,091,778 | 6/1963 | Gross . | |
| 3,166,282 | 1/1965 | Nolan . | |
| 3,286,970 | 11/1966 | Nolan . | |
| 3,307,204 | 3/1967 | Cotner . | |
| 3,419,044 | 12/1968 | Daniels et al. . | |
| 3,994,030 | 11/1976 | Cassell et al. | 4/563.1 |
| 4,075,719 | 2/1978 | Sullivan | 4/563.1 X |
| 4,221,008 | 9/1980 | Nolan . | |
| 4,589,432 | 7/1986 | Pennington-Richards | 4/563.1 |
| 4,941,216 | 7/1990 | Boublil . | |
| 4,996,728 | 3/1991 | Nolan . | |
| 5,103,509 | 4/1992 | Richards . | |
| 5,146,638 | 9/1992 | Richards . | |

*Primary Examiner*—Charles E. Phillips
*Attorney, Agent, or Firm*—Camoriano & Smith

[57] ABSTRACT

A seat lift includes a cylinder, a frame, a seat, and a block which wraps around the cylinder and moves with the frame to support the frame.

6 Claims, 5 Drawing Sheets

SEAT LIFT

BACKGROUND OF THE INVENTION

This invention pertains to a chair lift in which a handicapped person sits to be lowered into a swimming pool and lifted out of the pool.

Chair lifts are well-known. Many different designs have been used. One design, shown in U.S. Pat. No. 4,221,008 "Nolan", mounts the seat on a cylinder, which moves up and down on a rod mounted in the pool. The cylinder also automatically pivots about its axis to rotate the person 90° so the seat is over the deck when it is in the "up" position and over the pool when it is in the "down" position. This design requires the lift to be more than twice as long as the vertical distance of travel. In order to make the lift more compact, so that it is only slightly longer than the distance of travel, the cylinder can be fixed, and the seat can be mounted on a frame fixed to the piston rod. This provides a much more compact design, but, since the seat is hanging off of the piston rod, there are substantial cantilever forces, which require the frame and piston rod to be beefed up to support the forces that are encountered when a person is sitting on the seat. In the prior art, it is known to use rollers to reduce the cantilever forces. The rollers of the prior art can roll straight up and down, but they are not suitable when the piston rod has to pivot 90°. Also, rollers are not suitable for supporting the frame against tangential forces.

The lift shown in U.S. Pat. No. 4,221,008 "Nolan" has a piston which is doughnut-shaped in order to fit outside the rod as required by that design. This greatly reduces the surface area over which the fluid acts and therefore reduces the power of a lift as compared with a lift with the same diameter cylinder using a solid circular piston.

SUMMARY OF THE INVENTION

The present invention provides a compact, relatively lightweight lift by mounting the seat on a frame extending from the piston rod and by supporting the cantilever forces with a sliding block, which contacts the cylinder and slides along the outside surface of the cylinder as the seat moves up and down and pivots. The sliding block has a curved surface which wraps around the cylinder, so as to support both radially-directed forces and tangentially-directed forces, as will be explained in the description.

The present invention uses far fewer parts than the prior art designs and has a power gain of approximately 25% over the design of U.S. Pat. No. 4,221,008, because it has a solid circular piston (no central hole as in the prior art).

DESCRIPTION OF THE PREFERRED EMBODIMENT

Figure 1:
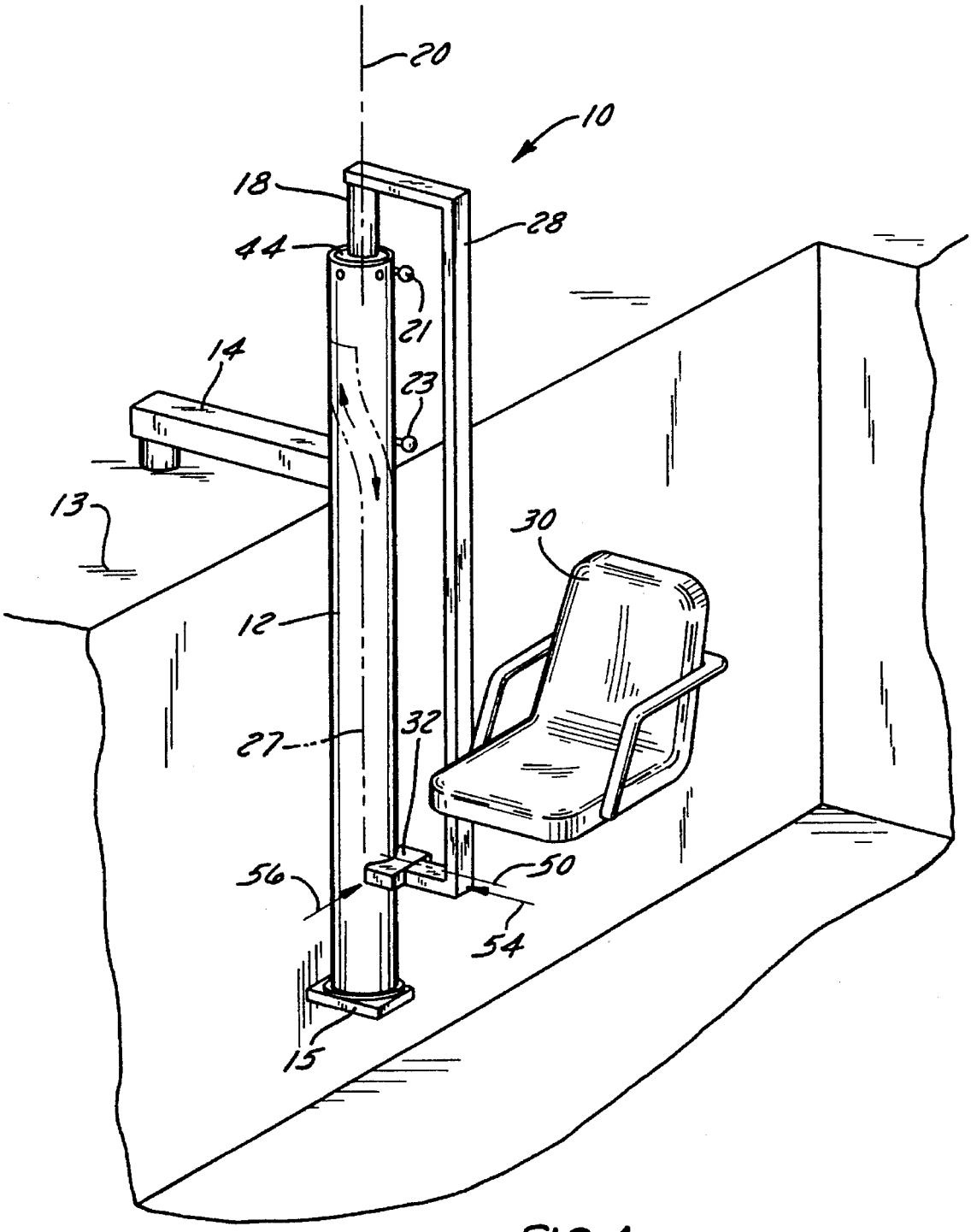
FIG. 1 is a schematic perspective view of a chair lift made in accordance with the present invention.
Figure 2:
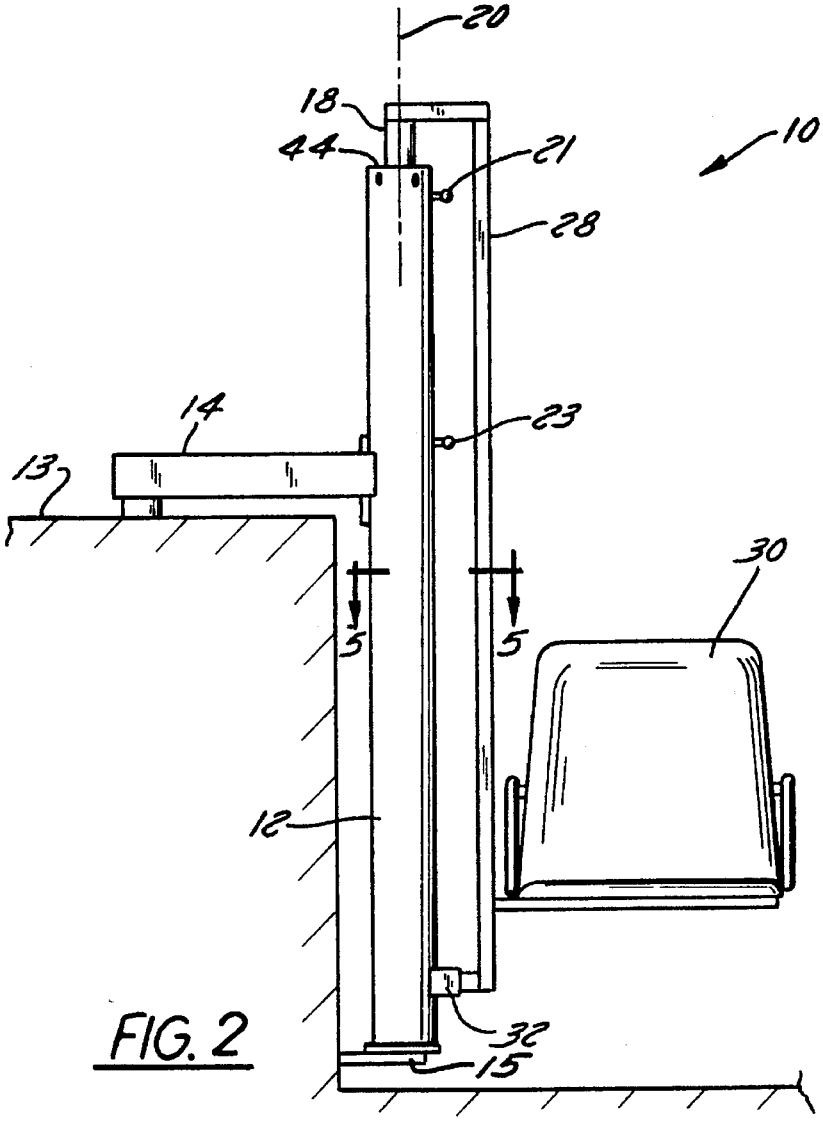
FIG. 2 is a front view thereof.
Figure 3:
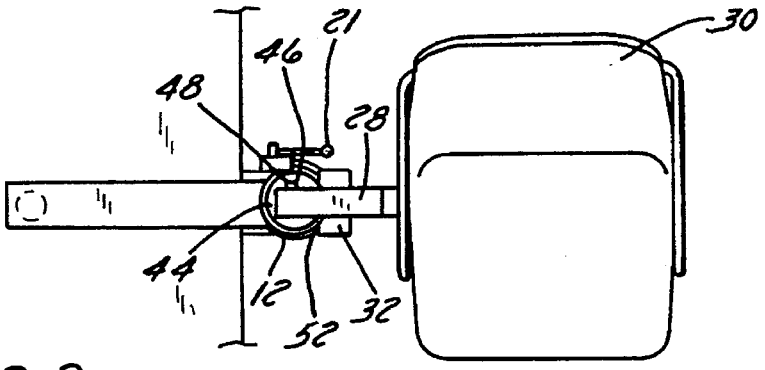
FIG. 3 is a top view thereof.

Referring now to FIGS. 1–9, the preferred embodiment of the chair lift 10 includes a cylinder 12, which is fixed to the pool deck 13 by means of a mounting arm 14 and rests against the pool wall by means of a bracket 15. The mounting arm 14 is preferably welded to the cylinder 12 so as to leave a substantial portion of the cylinder 12 free to receive a sliding block.

Figure 7:
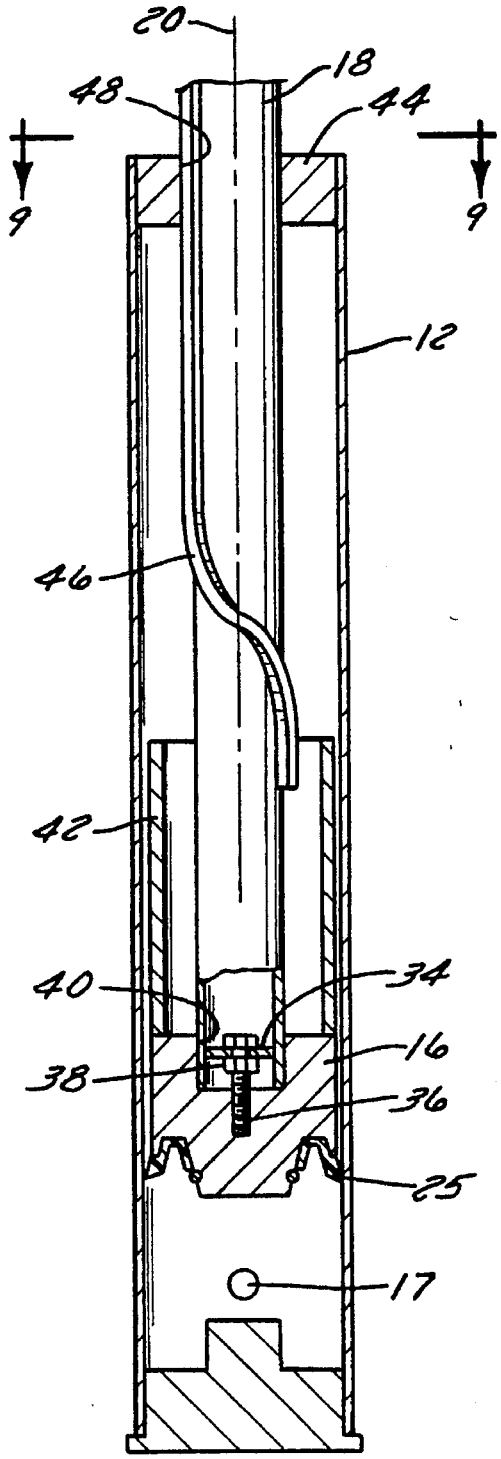
FIG. 7 is a section view through the cylinder.

Inside the cylinder 12 is a piston 16, shown in FIG. 7. The cylinder 12 receives water under pressure through the opening 17, which causes the piston 16 to move up in the cylinder 12. The upper and lower handles 21, 23 control a valve (not shown) which, in one position, introduces pressurized water into the cylinder 12 through the opening 17, to cause the piston 16 to move up, and, in another position, allows water to vent out of the cylinder 12 through the opening 17, which allows the piston 16 to move down. The person sitting in the lift can reach the upper handle 21 when seated on the lift in the "up" position and can reach the lower handle 23 when seated on the lift in the "down" position.

A piston rod 18 is mounted to the piston 16 in such a manner that the piston 16 moves up and down (axially) without rotating relative to the cylinder 12, while the piston rod 18 moves up and down axially with the piston 16 and rotates about its own axis. The piston 16 does not rotate relative to the cylinder 12, because the seal 25 between the piston 16 and cylinder 12 cannot readily rotate relative to the cylinder 12.

The mounting arrangement which permits the piston rod 18 to rotate relative to the piston 16, as shown in FIG. 7, will now be described. A circular plate 34 is welded into the piston rod 18 near the end of the rod 18. The plate 34 has a hole in its center, through which a bolt 36 extends. A nut 38 on the bolt 36 secures the bolt 36 to the plate 34 with a loose fit, so that the piston rod 18 can rotate relative to the axially-located bolt 36. The bolt 36 is threaded into the piston 16, which ensures that the piston rod 18 moves up and down with the piston 16. The piston rod 18 is received in a cylindrical indentation 40 in the piston 16 with a clearance fit, so that the piston rod 18 can rotate relative to the piston 16 but is maintained in the proper upright, axially-aligned position relative to the piston 16.

The spacer 42 is simply a loose cylindrical piece, such as a piece of plastic pipe, which rests on top of the piston 16, surrounding the bottom portion of the piston rod 18, and serves as a stop. When pressurized water is introduced into the cylinder 12, and the piston 16 moves upwardly, the spacer 42 rides up with the piston 16 until it hits the collar 44, and, at that point, the spacer 42 stops the upward travel of the piston 16.

The piston rod 18 has a curved track 46 welded to its outside surface. A collar 44 is fixed to the top of the cylinder 12 by means of bolts which extend through holes in the collar and cylinder. The collar 44 has a contoured indentation 48 which receives the track 46 so that, as the piston rod 18 moves up and down axially in the cylinder 12, the cooperation of the track 46 and the indentation 48 causes the piston rod 18 to rotate 90° about its axis 20. Of course, it would also be possible to shape the track 46 so that the piston rod rotates more than 90° if so desired.

A support frame 28 is mounted to the top of the piston rod 18 and projects laterally and downwardly, so that the majority of the support frame 28 is parallel to the cylinder 12. A seat 30 is mounted on the frame 28 toward the bottom of the frame 28. At the bottom of the frame 28 is a slide block 32, which contacts the outside surface of the cylinder 12. The slide block 32 supports forces perpendicular to the axis of the cylinder 12, so as to relieve cantilever forces from the top of the support frame 28. We will assume for this discussion that the cylinder is mounted vertically, which means that the slide block 32 supports horizontal forces.

Figure 4:
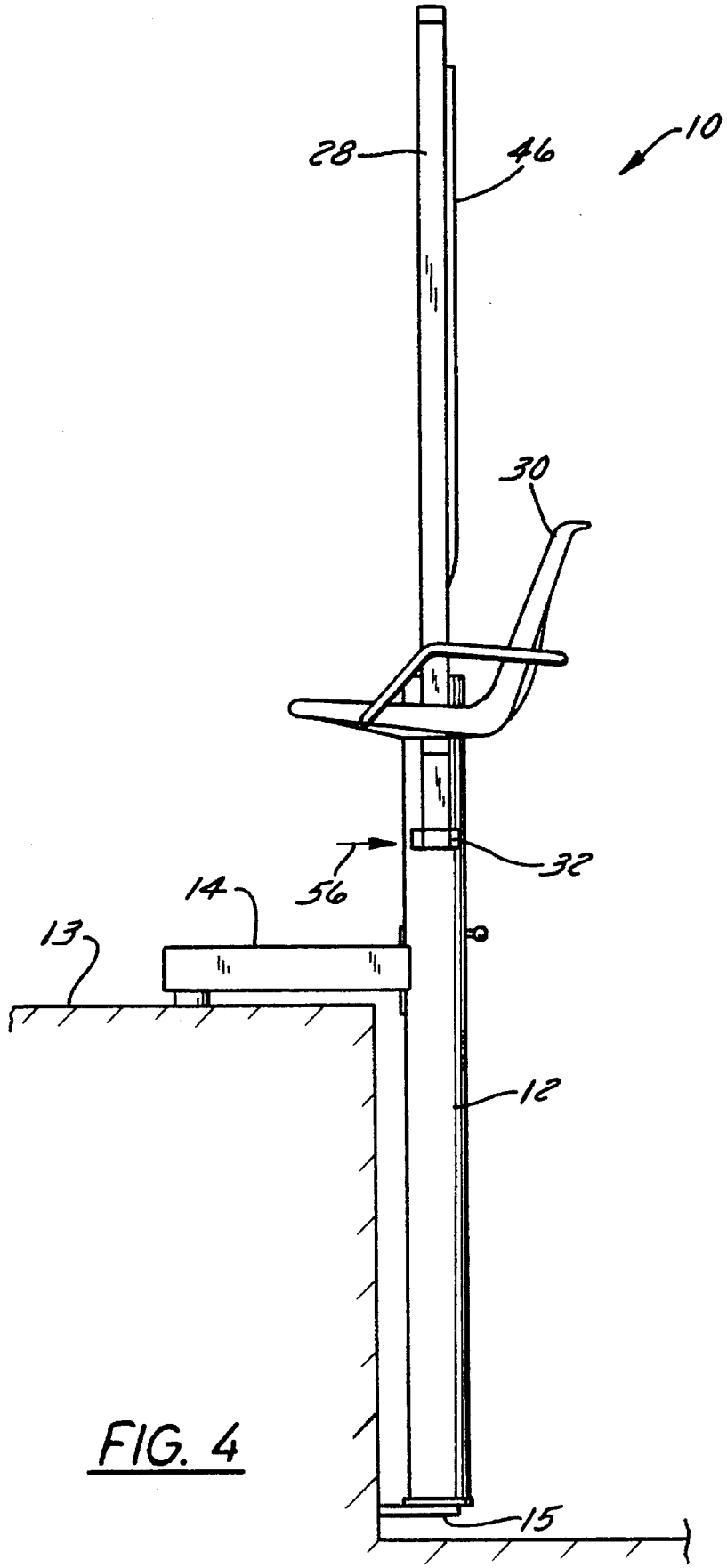
FIG. 4 is the same view as FIG. 2, but with the chair in the "up" position and pivoted 90° from the position shown in FIG. 2.

When the lift is in the "down" position, as shown in FIG. 1, the frame 28 lies adjacent to the cylinder 12, making a very compact package which is only slightly longer than the distance of travel of the lift. When the lift is in the "up" or "extended" position, as shown in FIG. 4, the frame 28 is extended above the cylinder 12, at which point the total height of the lift is comparable to the heights of some of the prior art lifts described earlier.

As the piston rod 18 moves up and down and rotates, the block 32 slides up and down and along a curved path on the outside surface of the cylinder 12. This curved path 27 is shown in phantom in FIG. 1. The surface of the block 32 which contacts the cylinder 12 is curved (as seen best in FIG. 5), so as to wrap partially around the cylinder 12. This permits the block 32 to support horizontal forces in several directions.

In the preferred embodiment, the angle alpha (shown in FIG. 5) from an imaginary line 50, bisecting the support frame 28 to the front-most portion 52 of the slide block 32 in contact with the cylinder 12, is approximately 40 degrees. It is preferably at least 30 degrees. The angle beta, from the imaginary line 50 to the back-most portion of the slide block 32 is approximately 20 degrees. This means that the slide block 32 wraps around the cylinder at least 50°, and preferably 60° or more.

Figure 5:
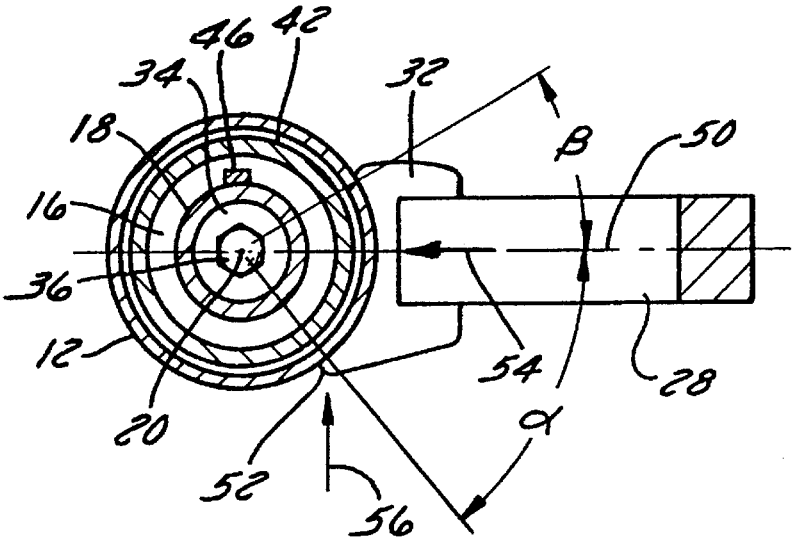
FIG. 5 is a view taken along the Section 5—5 of FIG. 2.
Figure 8:
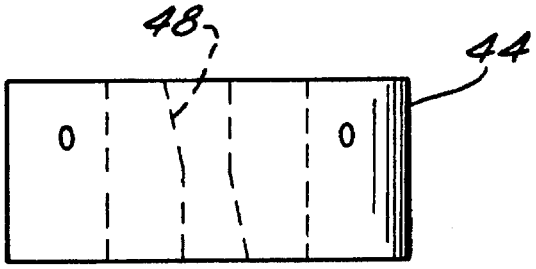
FIG. 8 is a front view of the collar, which has been removed from the cylinder of FIG. 7.
Figure 9:
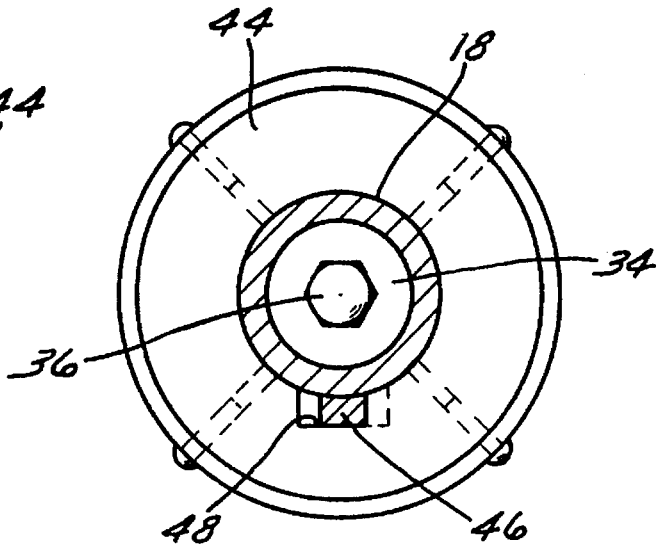
FIG. 9 is a view taken along the section 9—9 of FIG. 7.
Figure 6:
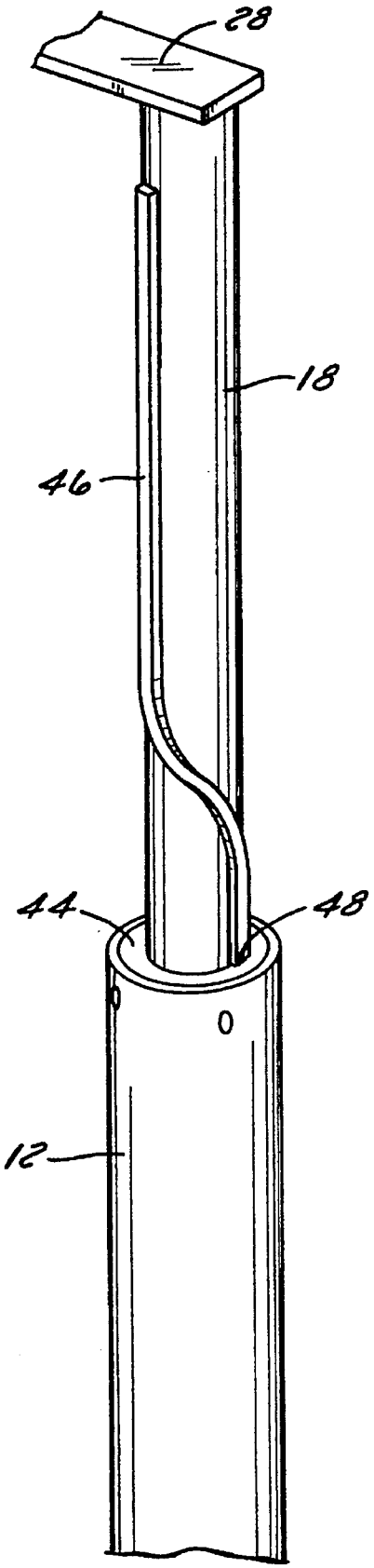
FIG. 6 is a perspective view showing the piston rod and cylinder when the chair lift is in the "up" position.

As shown in FIG. 5, the block 32 can support radially-directed horizontal forces, as indicated by the arrow 54, and tangentially-directed horizontal forces, as indicated by the arrow 56. The radially-directed forces would be generated primarily from the weight of the person on the chair lift. The tangentially-directed forces could come from the person swinging his legs or from pushing against the deck 13 when the person is getting onto or off of the seat when the lift is in the "up" position or against the bottom of the pool when the lift is in the "down" position. If the block 32 did not wrap around the cylinder 12, then it would not be able to support the tangential forces 56, and, if the person pushed a bit from the deck or swung his feet while on the seat, then the block 32 might slide back, off of the cylinder 12, which would be undesirable. It would then be necessary to beef up the frame 28 to support those tangentially-directed forces. However, since the block 32 can support those forces, the frame can be made more lightweight.

The operation of the lift 10 is as follows:

The lift 10 begins in the "down" position, shown in FIG. 1. A person approaches the lift 10 along the deck 13 on crutches, on a wheelchair, or walking, and the person moves the upper handle 21, which opens the water inlet valve (not shown). The pressurized water causes the piston to move up, lifting the piston rod 18, the frame 28, and the seat 30, until the lift is in the "up" position, shown in FIG. 4. The person then sits down on the seat 30.

The person then moves the upper handle 21 to another position, so the water leaves the cylinder 12, allowing the seat 30 to go back down. As the seat 30 goes down, it pivots 90° so the person's legs clear the deck 13 on the way down. Once the person's chest is at the water level, the person floats off of the seat 30 and can swim in the pool.

When the person is ready to get out of the pool, he swims back to the seat 30 and sits on it. He pushes the lower control handle 23, causing the water to enter the cylinder 12. This again lifts the seat 30 and person up, and, once the seat has cleared the deck 13, it begins to rotate 90°, bringing the person back over the deck.

It will be obvious to those skilled in the art that modifications may be made to the embodiment described above without departing from the scope of the present invention.

What is claimed is:

1. A seat lift, comprising:

a cylinder having a vertically-oriented axis;

a piston movably retained in said cylinder;

a piston rod projecting from said piston; said piston and said piston rod being movable along said vertically-oriented axis of said cylinder, and said piston rod being to rotatable about said vertically-oriented axis of said cylinder;

a frame mounted on said piston rod for receiving a seat, said frame being rotatable with said piston rod about the axis of said cylinder; and a slide block mounted on said frame and in contact with an external surface of said cylinder, so as to support said frame horizontally with respect to said cylinder, wherein said slide block moves up and down and in a rotary manner on said external surface of said cylinder as the frame moves up and down and rotates about the axis of said cylinder.

2. A seat lift as recited in claim 1, wherein the surface of the slide block which contacts the cylinder is curved so as to wrap at least partially around said cylinder, to enable the slide block to support radially-directed forces and tangentially-directed forces, and wherein said slide block supports said frame throughout the entire rate of travel of said frame.

3. A seat lift as recited in claim 2, wherein said piston rod rotates about its axis relative to the cylinder.

4. A seat lift as recited in claim 2, and further comprising a helical-like track defined along the outside of the piston rod; and a collar fixed on the cylinder; said collar defining an indentation which receives said track; such that, as said piston rod moves axially relative to the cylinder, the track stays in the indentation of the collar, causing said piston rod to rotate about its axis.

5. A seat lift as recited in claim 4, wherein said cylinder provides a substantially smooth surface on which said slide block slides throughout its entire distance of travel.

6. A seat lift as recited in claim 5, and further comprising a cylinder mounting arm for mounting said cylinder to a deck.

* * * * *

UNITED STATES PATENT AND TRADEMARK OFFICE

CERTIFICATE OF CORRECTION

PATENT NO. : 5,465,433

DATED : Nov. 14, 1995

INVENTOR(S) : J. David Nolan

It is certified that error appears in the above-identified patent and that said Letters Patent is hereby corrected as shown below:

Column 4, line 26, delete "to".

Column 4, line 43, substitute – range – for "rate".

Signed and Sealed this

Twentieth Day of July, 1999

*Attest:*

Q. TODD DICKINSON

*Attesting Officer*

*Acting Commissioner of Patents and Trademarks*